US010544581B2

(12) United States Patent
Lin et al.

(10) Patent No.: US 10,544,581 B2
(45) Date of Patent: Jan. 28, 2020

(54) PRESTRESSED TUBE SECTION STRUCTURE AND CONSTRUCTION METHOD THEREOF

(71) Applicant: CCCC Highway Consultants Co., Ltd., Beijing (CN)

(72) Inventors: Ming Lin, Beijing (CN); Xiaodong Liu, Beijing (CN); Haiqing Yin, Beijing (CN); Yi Li, Beijing (CN); Wei Lin, Beijing (CN); Shanshui Zhou, Beijing (CN)

(73) Assignee: CCCC Highway Consultants Co., Ltd., Beijing (CN)

( * ) Notice: Subject to any disclaimer, the term of this patent is extended or adjusted under 35 U.S.C. 154(b) by 93 days.

(21) Appl. No.: 15/870,550

(22) Filed: Jan. 12, 2018

(65) Prior Publication Data

US 2019/0063062 A1 Feb. 28, 2019

(30) Foreign Application Priority Data

Aug. 30, 2017 (CN) ..... 2017 1 07657198

(51) Int. Cl.
*E02D 29/073* (2006.01)
*E04B 1/68* (2006.01)
*E02D 29/063* (2006.01)

(52) U.S. Cl.
CPC ..... *E04B 1/6806* (2013.01); *E04B 1/6801* (2013.01); *E02D 29/063* (2013.01); *E04B 2001/6818* (2013.01)

(58) Field of Classification Search
CPC ..... E02D 29/073
(Continued)

(56) References Cited

FOREIGN PATENT DOCUMENTS

GB 2124277 A * 2/1984
JP 2005264672 A * 9/2005

OTHER PUBLICATIONS

Chinese document CN 204753636, 3 pages (Year: 2015).*

* cited by examiner

*Primary Examiner* — Sunil Singh
(74) *Attorney, Agent, or Firm* — Andrew D. Fortney; Central California IP Group, P.C.

(57) ABSTRACT

The present application discloses a prestressed tube section structure and a construction method thereof. The prestressed tube section structure includes multiple successively connected segments. A shear-resistant structure and a water stop system are arranged between two segments; multiple prestressing tendons are arranged in the tube section along the circumferential direction of the tube section; and each prestressing tendon is communicated along the longitudinal direction of the tube section, and is partitioned into multiple sections at a position close to a segment joint. By the arrangement of the multiple successively connected segments of the present application, the shear-resistant structure and the water stop system are arranged between the two segments, so that a portion between two segments may bear a shear force and have watertightness; the arrangement of the multiple prestressing tendons in the tube section enables the multiple segments to be connected in series and spliced into a whole; in addition, each prestressing tendon is partitioned into multiple sections at the position close to each segment joint, so that the tube section has higher flexibility on the premise of not losing the overall rigidity, and the loading capacity and deformability of each segment are effectively improved; and a proper pressure is applied between two segments, so that the tube section has higher deformability to adapt to a subsea foundation bed.

20 Claims, 3 Drawing Sheets

(58) Field of Classification Search
USPC ..... 52/223.6, 223.7, 223.9, 223.11, 223.14,
52/FOR. 164, FOR. 112
See application file for complete search history.

PRESTRESSED TUBE SECTION STRUCTURE AND CONSTRUCTION METHOD THEREOF

This application claims the benefit of Chinese Patent Application No. 2017107657198, filed Aug. 30, 2017, incorporated herein by reference in its entirety.

TECHNICAL FIELD

The present application relates to the technical field of immersed tunnels, and more particularly relates to a prestressed tube section structure and a construction method thereof.

BACKGROUND ART

With the continuous increase of cross-ocean tunnel engineering, an immersed-tube method for building a subsea tunnel is widely applied. An immersed tunnel is generally formed by transporting a plurality of factory-prefabricated standard tube sections to a sea surface site in a floating manner, jointing the tube sections at the seabed, and immersing them in a dredged foundation ditch. At the present, tube section structures for immersed tunnels which have been built at home and abroad are mainly classified into two types, including a segment type flexible tube section and an integrated type rigid tube section.

The flexible tube section is formed by successively connecting multiple segments in an end-to-end manner, and the segments are connected at segment joint positions through matched tenon structures and gap-crossing buried-in water stop bands. In case of an external load, this structure mainly shows its flexibility characteristic that the segment joints of the tube section are opened and rotate; tube section bending moments are released via deformation; as longitudinal stress on the structure is relatively low, a small number of longitudinal reinforcing bars are provided; however, a portion between tube section segments is low in shear resistance and water resistance to result in a water stop risk between the tube section segments, and a relatively high risk will be caused if the flexible tube section is applied to a high-load or soft-foundation immersed tunnel.

The rigid tube section is an integrated tube section or is formed by connecting multiple tube section segments in an end-to-end manner through bonded prestress. The tube section may resist an external load with its overall rigidity; due to relatively high longitudinal stress on the tube section, it needs to arrange a large number of steel bars or set massive prestress to improve the bearing capacity of the tube section; in addition, the rigid tube section may not redistribute a structural internal force via tube section flexible deformation, so that the stress inside the structure is not uniform, and a region pressed by a relatively high force may have cracking and water leakage risks due to a long-time high stress; and the tube section also may not adapt to a subsea complicated settling environment by itself.

SUMMARY OF THE INVENTION

For the purpose of solving the problems that an existing rigid tube section may not redistribute a structural internal force via tube section flexible deformation, and also may not adapt to a subsea complicated settling environment by itself in an immersed tunnel construction process, the present application provides a prestressed tube section structure. The immersed tube section has certain flexibility on the premise of not losing the overall rigidity, so that stress on each tube section segment is effectively improved, and the tube section may adapt to the subsea complicated settling environment by itself.

In order to achieve the above invention purpose, the present application provides the following technical scheme:

A prestressed tube section structure is provided, including multiple successively connected segments. A shear-resistant structure and a water stop system are arranged between two segments; multiple prestressing tendons are arranged in the tube section along the circumferential direction of the tube section; and each prestressing tendon is communicated along the longitudinal direction of the tube section, and is partitioned into multiple sections at a position close to a segment joint.

By the arrangement of the multiple successively connected segments of the present application, the shear-resistant structure and the water stop system are arranged between two segments, so that a portion between two segments may bear a shear force and have watertightness; the arrangement of the multiple prestressing tendons in the tube section enables the multiple segments to be connected in series and spliced into a whole; in addition, each prestressing tendon is partitioned and cut off at the position close to each segment joint, namely each prestressing tendon is partitioned into the multiple sections, so that a certain opening deformation is allowed between two segments of the tube section, the tube section has higher flexibility on the premise of not losing the overall rigidity, and the loading capacity and deformability of each segment are effectively improved; and a proper pressure is applied between two segments, so that the tube section has higher deformability to adapt to a subsea foundation bed.

As a preferred scheme of the present application, each water stop system includes a buried-in water stop band and an OMEGA water stop band which are disposed between adjacent segment joints, and a full circle of each of the buried-in water stop band and the OMEGA water stop band is disposed along the circumferential direction of the tube section. The arrangement of one circle of buried-in water stop band and one circle of OMEGA water stop band between the segment joints may prevent seawater outside the tube section from entering an inner cavity of the tube section from a gap between the segment joints.

As a preferred scheme of the present application, each shear-resistant structure includes an inner sleeve and an outer sleeve which are respectively buried in concrete of adjacent segments, and the outer sleeve is arranged at the front part of the inner sleeve in a sleeving manner. The inner sleeve and the outer sleeve which cooperate with each other are respectively arranged in the concrete of two segments, and the shear force between the segments is borne by mutual pressing action between contact surfaces of the inner sleeve and the outer sleeve, so that the shear resistance of each segment joint may be effectively improved to prevent radial displacement of the tube section segments, thus integrally improving the connection stability of the respective tube section segments and enabling the whole spliced tube section to be more stable and reliable.

As a preferred scheme of the present application, a shock absorption layer is arranged between the contact surfaces of the inner sleeve and the outer sleeve, may play a certain role in buffering shake occurring between the segments, and may also avoid contact stress fatigue caused by long-time direct contact of the inner sleeve and the outer sleeve.

As a preferred scheme of the present application, the shock absorption layer is a rubber pad arranged between the contact surfaces of the inner sleeve and the outer sleeve.

As a preferred scheme of the present application, multiple welding studs are arranged on the outer walls of both the inner sleeve and the outer sleeve, so that a drawing force between the inner and outer sleeves and the concrete may be enlarged.

The present application further provides a construction method of a prestressed tube section structure, including:

a. binding reinforcement cages, and pouring concrete;

b. carrying out prestress tensioning construction on the tube section, and connecting and splicing multiple segments in series into a whole;

c. after the tube section is installed in place underwater, carrying out section cutting on prestressing tendons of the tube section.

According to the construction method of the present application, after the tube section is subjected to pouring, hardening and forming and the prestressing tendon construction is completed, each prestressing tendon is partitioned into multiple sections at a position close to each segment joint, so that the tube section may have higher flexibility on the premise of not losing the overall rigidity, and the loading capacity and deformability of each segment are effectively improved; and a proper pressure is applied between two segments, so that the tube section has higher deformability to adapt to a subsea foundation bed.

As a preferred scheme of the present application, in the step a, reinforcement cage binding and concrete pouring are carried out in sequence according to the segments, and shear-resistant structures and water stop systems are arranged at the segment joints.

As a preferred scheme of the present application, in the step a, before the pouring, cutting sleeves further need to be buried into prestressing tendon cutting positions close to the segment joints. The cutting sleeves are buried before the concrete pouring, thus facilitating subsequent cutting-off construction of the prestressing tendons.

As a preferred scheme of the present application, in the step c, the section cutting is carried out on the prestressing tendons with a chain saw through the cutting sleeves. A saw chain portion on the chain saw may enter the cutting sleeves to cut off the prestressing tendons.

Compared with the Prior Art, the Prestressed Tube Section Structure and the Construction Method Thereof have the Beneficial Effects that:

1. by the arrangement of the multiple successively connected segments of the present application, the shear-resistant structure and the water stop system are arranged between two segments, so that a portion between the two segments may bear the shear force and have the watertightness; the arrangement of the multiple prestressing tendons in the tube section enables the multiple segments to be connected in series and spliced into a whole; in addition, each prestressing tendon is partitioned and cut off at the position close to each segment joint, namely each prestressing tendon is partitioned into the multiple sections, so that a certain opening deformation is allowed between two segments of the tube section, the tube section has the higher flexibility on the premise of not losing the overall rigidity, and the loading capacity and deformability of each segment are effectively improved; and a proper pressure is applied between two segments, so that the tube section has higher deformability to adapt to the subsea foundation bed;

2. the inner sleeve and the outer sleeve which cooperate with each other are respectively arranged in the concrete of two segments, and the shear force between the segments is borne by mutual pressing action between the contact surfaces of the inner sleeve and the outer sleeve, so that the shear resistance of each segment joint may be effectively improved to prevent the radial displacement of the tube section segments, thus integrally improving the connection stability of the respective tube section segments and enabling the whole spliced tube section to be more stable and reliable;

3. before the pouring, cutting sleeves are buried into the prestressing tendon cutting positions close to the segment joints, and the saw chain portion on the chain saw may enter the cutting sleeves, thus facilitating the subsequent cutting-off construction of the prestressing tendons.

MARKERS IN THE DRAWINGS

1 for pre-poured end, 2 for matching end, 3 for shear-resistant structure, 31 for inner sleeve, 32 for outer sleeve, 33 for welding stud, 34 for rubber pad, 4 for buried-in water stop band, 5 for OMEGA water stop band, 6 for prestressing tendon, 61 for cutting sleeve, 62 for stay position of chain saw when the prestressing tendon is cut off, 63 for cutting position, and 7 for joint fireproofing component.

DETAILED DESCRIPTION OF THE INVENTION

A further detailed description will be made to the present application in combination with test cases and specific implementation modes below, but it should not be understood that the scope of the subject of the present application is only limited by embodiments as follows. Technologies implemented on the basis of contents of the present application shall all fall within the scope of the present application.

Embodiment 1

Figure 1:
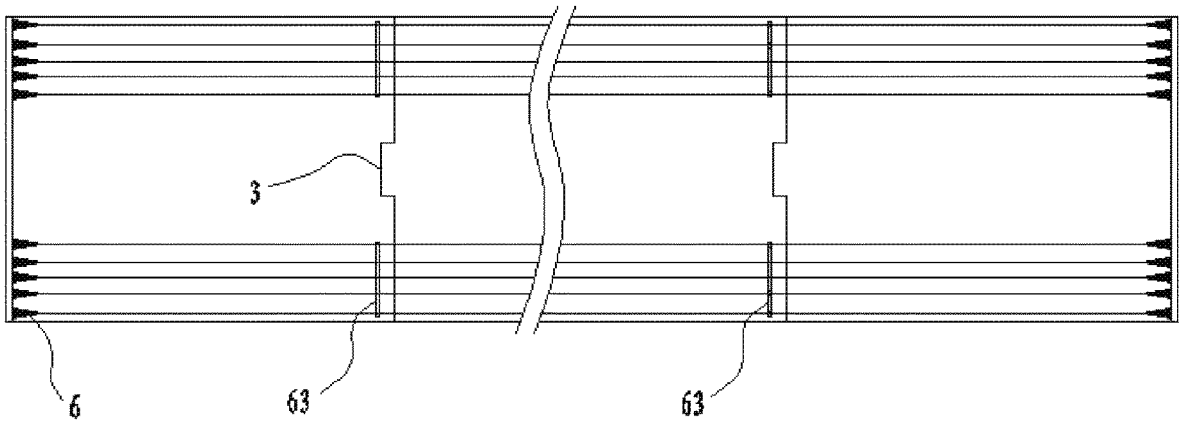
FIG. 1 is a schematic diagram of a prestressed tube section structure in the present application.
Figure 2:
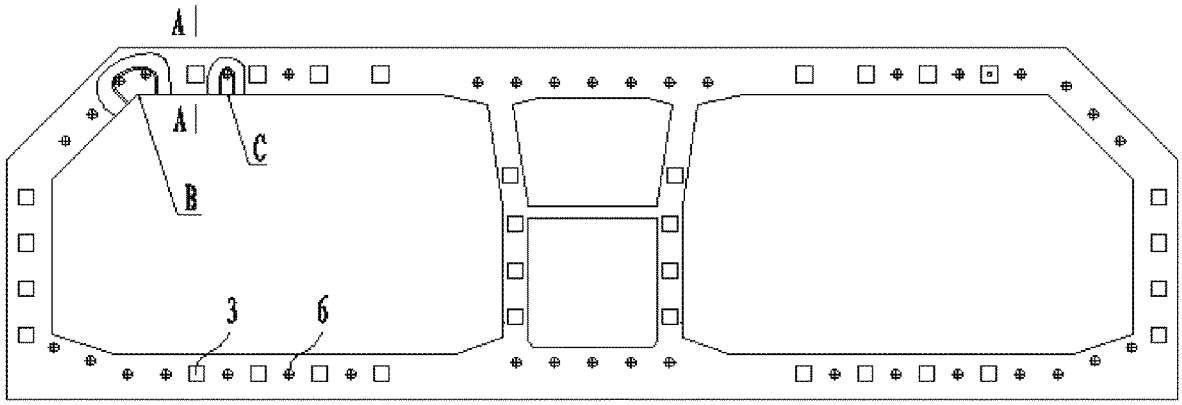
FIG. 2 is a schematic diagram of an end surface of a segment joint of a prestressed tube section structure in the present application.
Figure 3:
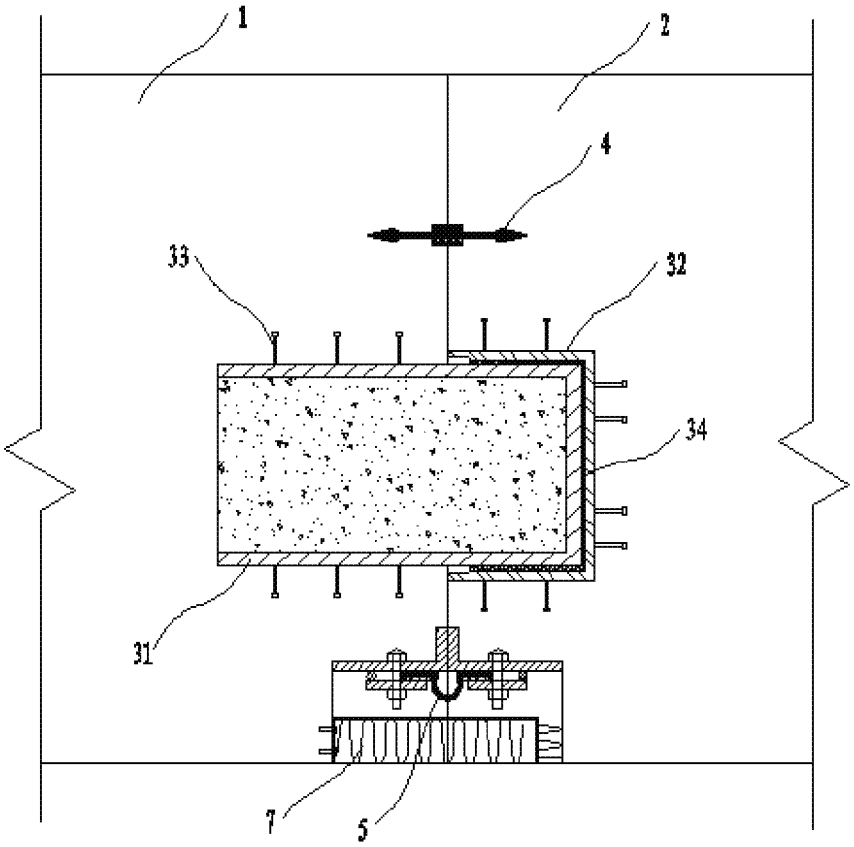
FIG. 3 is a section view of A-A in FIG. 2.
Figure 4:
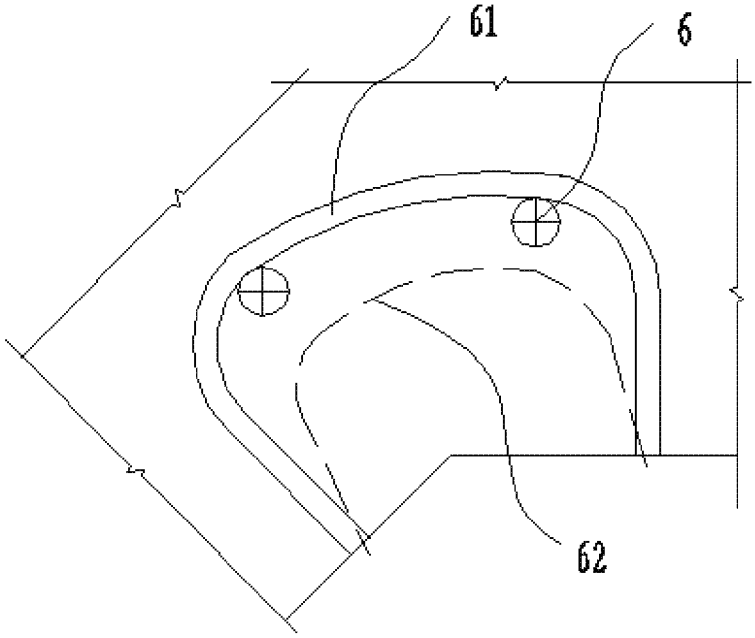
FIG. 4 is a local schematic diagram of a portion B in FIG. 2.
Figure 5:
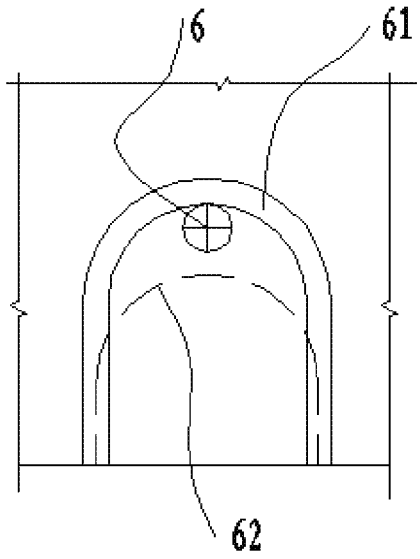
FIG. 5 is a local schematic diagram of a portion C in FIG. 2.

This embodiment provides a prestressed tube section structure;

as shown in FIGS. 1 to 5, the prestressed tube section structure in this embodiment includes multiple successively connected segments. A shear-resistant structure 3 and a water stop system are arranged between two segments; multiple prestressing tendons 6 are arranged in the tube section along the circumferential direction of the tube section; each prestressing tendon 6 is communicated along the longitudinal direction of the tube section, and is partitioned into multiple sections at a position close to a segment joint; and multiple cutting positions 63 are set on the whole tube section.

In this embodiment, each water stop system includes a buried-in water stop band 4 and an OMEGA water stop band 5 which are disposed between adjacent segment joints, and a full circle of each of the buried-in water stop band 4 and the OMEGA water stop band 5 is disposed along the circumferential direction of the tube section. The arrangement of one circle of buried-in water stop band and one circle of OMEGA water stop band between the segment joints may prevent seawater outside the tube section from entering an inner cavity of the tube section from a gap between the segment joints. In addition, joint fireproofing components 7 for protecting the water stop bands are also arranged on the outer sides of the OMEGA water stop bands.

In this embodiment, each shear-resistant structure 3 includes an inner sleeve 31 and an outer sleeve 32 which are respectively buried in concrete of a pre-poured end 1 and a matching end 2, and the outer sleeve 32 is arranged at the front part of the inner sleeve 31 in a sleeving manner. The inner sleeve and the outer sleeve which cooperate with each other are respectively arranged in the concrete of two segments, and a shear force between the segments is borne by mutual pressing action between contact surfaces of the inner sleeve and the outer sleeve, so that the shear resistance of each segment joint may be effectively improved to prevent radial displacement of the tube section segments, thus integrally improving the connection stability of the respective tube section segments and enabling the whole spliced tube section to be more stable and reliable.

In this embodiment, a shock absorption layer is arranged between the contact surfaces of the inner sleeve 31 and the outer sleeve 32, may play a certain role in buffering shake occurring between the segments, and may also avoid contact stress fatigue caused by long-time direct contact of the inner sleeve and the outer sleeve. The shock absorption layer in this embodiment is a rubber pad 34 arranged between the contact surfaces of the inner sleeve and the outer sleeve. In addition, in this embodiment, multiple welding studs 33 are arranged on the outer walls of both the inner sleeve and the outer sleeve, so that a drawing force between the inner and outer sleeves and the concrete may be enlarged.

By the arrangement of the multiple successively connected segments in this embodiment, the shear-resistant structure and the water stop system are arranged between two segments, so that a portion between two segments may bear the shear force and have watertightness; the arrangement of the multiple prestressing tendons in the tube section enables the multiple segments to be connected in series and spliced into a whole; in addition, each prestressing tendon is partitioned and cut off at the position close to each segment joint, namely each prestressing tendon is partitioned into the multiple sections, so that a certain opening deformation is allowed between two segments of the tube section, the tube section has higher flexibility on the premise of not losing the overall rigidity, and the loading capacity and deformability of each segment are effectively improved; and a proper pressure is applied between two segments, so that the tube section has higher deformability to adapt to a subsea foundation bed.

Embodiment 2

This embodiment further provides a construction method of a prestressed tube section structure; as shown in FIGS. 1 to 5, the construction method of the prestressed tube section structure includes:

a. binding reinforcement cages, and pouring concrete;

b. carrying out prestress tensioning construction on the tube section, and connecting and splicing multiple segments in series into a whole;

c. after the tube section is installed in place underwater, carrying out section cutting on prestressing tendons of the tube section.

In this embodiment, in the step a, reinforcement cage binding and concrete pouring are carried out in sequence according to the segments, and a specific operation process is as follows: on a reinforcement cage binding production line, after binding of one segment reinforcement cage is completed in a base plate region, the segment reinforcement cage needs to be pushed into a middle wall region for secondary binding, and at the same time, base plate binding of a next segment reinforcement cage is carried out in the base plate region; after the middle wall binding is completed, the segment reinforcement cage needs to be pushed to a top plate region to complete final segment reinforcement cage binding work, and then is pushed to a pouring region for concrete pouring construction; and all the later segment reinforcement cages in the binding regions are followed up. In addition, at first matching of all the segments, it needs to arrange the shear-resistant structures 3, the buried-in water stop bands 4 and the OMEGA water stop bands 5 at the segment joints. It should be noted that the OMEGA water stop bands are installed on the inner walls of two segments through bolts and pressing plates after the pouring is completed. In addition, the joint fireproofing components 7 which are arranged on the outer sides of the OMEGA water stop bands to protect the water stop bands are also installed after the tube section pouring is completed.

In this embodiment, in the step a, before the pouring, cutting sleeves 61 further need to be buried into prestressing tendon cutting positions close to the segment joints. The cutting sleeves are PE plastic sleeves which are U-shaped tubes, and may surround the prestressing tendons. The cutting sleeves have the diameter of 5 to 7 cm; steel wires for pulling shall be retained in the prestressing tendon cutting sleeves; temporary blocking measures shall be taken for opening portions of the sleeves so as to prevent blocking during concrete pouring; and the cutting sleeves are buried before the concrete pouring, thus facilitating subsequent cutting-off construction of the prestressing tendons.

In this embodiment, in the step b, during the concrete pouring, multiple prestressed pipelines need to be buried in the tube section; after the concrete is solidified, the prestressing tendons are correspondingly put into the respective pipelines in a penetrating manner, and then are tensioned according to a certain tensioning sequence; and meanwhile, prestressed anchors for anchoring the prestressing tendons are arranged at two ends of the tube section. The prestressed anchors in this embodiment are common measures for anchoring the prestressing tendons in this field, so that no more descriptions of their specific structures will be given here.

In this embodiment, in the step c, the section cutting is carried out on the prestressing tendons with a chain saw through the cutting sleeves. A saw chain portion on the chain saw may be pulled by the steel wires to enter the cutting sleeves 61 to cut off the prestressing tendons, and the chain saw approximately stops at a position 62 when the prestressing tendons are cut off. By the adoption of the chain saw to cut off the prestressing tendons, the chain saw stops cutting when cutting off the prestressing tendons; when the prestressing tendons are cut off, attentions should be paid to protection of the OMEGA water stop bands; on the premise of ensuring that the prestressing tendons are cut off, the cutting amount of the concrete shall be reduced as much as possible; after the prestressing tendons are cut off, cutting-off holes are grouted and filled with micro-expanding cement mortar.

According to the construction method of the present application, after the tube section is subjected to pouring, hardening and forming and the prestressing tendon construction is completed, each prestressing tendon is partitioned into multiple sections at a position close to each segment joint, so that the tube section may have higher flexibility on the premise of not losing the overall rigidity, and the loading capacity and deformability of each segment are effectively improved; and a proper pressure is applied between two segments, so that the tube section has higher deformability to adapt to a subsea foundation bed.

The above-mentioned embodiments are only preferred embodiments of the present application, but not intended to limit the present application. Any modifications, equivalent replacements, improvements and the like which are made within the principle of the present application shall all fall within the protection scope of the present application.

The invention claimed is:

1. A prestressed tube section structure, comprising multiple successively connected segments, a shear-resistant structure and a water stop system between two of the multiple successively connected segments, and multiple prestressing tendons in a tube section of the prestressed tube section structure along a circumferential direction of the tube section; wherein each prestressing tendon is communicated along a longitudinal direction of the tube section and is partitioned into multiple sections at a position close to a segment joint, each water stop system comprises a buried-in water stop band and an OMEGA water stop band between adjacent segment joints, a full circle of each of the buried-in water stop band and the OMEGA water stop band is along the circumferential direction of the tube section, each shear-resistant structure comprises an inner sleeve and an outer sleeve respectively buried in concrete of adjacent segments, the outer sleeve is over a front of the inner sleeve in a sleeving manner, and the prestressed tube section structure includes multiple welding studs on outer walls of both the inner sleeve and the outer sleeve.

2. The prestressed tube section structure according to claim 1, further comprising a shock absorption layer between the contact surfaces of the inner sleeve and the outer sleeve.

3. The prestressed tube section structure according to claim 2, wherein the shock absorption layer comprises a rubber pad between contact surfaces of the inner sleeve and the outer sleeve.

4. The prestressed tube section structure according to claim 1, wherein the inner sleeve and the outer sleeve are configured so that contact surfaces of the inner sleeve and the outer sleeve bear a shear force between the adjacent segments.

5. The prestressed tube section structure according to claim 1, wherein the prestressed tube section structure is configured to improve a shear resistance of each segment joint and/or prevent radial displacement of the adjacent segments.

6. The prestressed tube section structure according to claim 5, wherein the prestressed tube section structure is configured to integrally improve a connection stability of the adjacent segments.

7. The prestressed tube section structure according to claim 1, further comprising joint fireproofing components arranged on outer sides of the OMEGA water stop bands.

8. The prestressed tube section structure according to claim 1, wherein the shear-resistant structure and the water stop system are between two of the adjacent segments, so that a portion between the two adjacent segments may bear a shear force and have watertightness.

9. The prestressed tube section structure according to claim 1, wherein the OMEGA water stop bands are on the inner walls of the adjacent segments through bolts and pressing plates.

10. The prestressed tube section structure according to claim 1, further comprising cutting sleeves in prestressing tendon cutting positions close to the adjacent segment joints.

11. The prestressed tube section structure according to claim 1, wherein the cutting sleeves are adapted for a chain saw to pass through and cut the prestressing tendons.

12. The prestressed tube section structure according to claim 11, wherein the cutting sleeves comprise plastic U-shaped tubes that surround the prestressing tendons.

13. The prestressed tube section structure according to claim 11, wherein the cutting sleeves have a diameter of 5 to 7 cm.

14. The prestressed tube section structure according to claim 1, further comprising prestressed anchors at ends of the tube section for anchoring the prestressing tendons.

15. A construction method of the prestressed tube section structure according to claim 1, comprising:

a. binding reinforcement cages and pouring concrete;

b. carrying out prestress tensioning construction on the tube section of the prestressed tube section structure, and connecting and splicing multiple segments in series into a whole; and c. after the tube section is installed in place underwater, carrying out section cutting on prestressing tendons of the tube section.

16. The construction method according to claim 15, wherein binding the reinforcement cages and pouring the concrete are carried out in sequence according to the multiple segments, and the method further comprises arranging shear-resistant structures and water stop systems at segment joints.

17. The construction method according to claim 16, wherein before pouring the concrete, the method further comprises burying cutting sleeves into prestressing tendon cutting positions close to the segment joints.

18. A construction method for a prestressed tube section structure, the prestressed tube section structure comprising multiple successively connected segments, a shear-resistant structure and a water stop system between two of the multiple successively connected segments, and multiple prestressing tendons in a tube section of the prestressed tube section structure along a circumferential direction of the tube section, wherein each prestressing tendon is communicated along a longitudinal direction of the tube section and is partitioned into multiple sections at a position close to a segment joint, the method comprising:

a. binding reinforcement cages and pouring concrete in sequence according to the multiple segments, wherein before pouring the concrete, the method further comprises burying cutting sleeves into prestressing tendon cutting positions close to the segment joints;

b. arranging shear-resistant structures and water stop systems at segment joints;

c. carrying out prestress tensioning construction on the tube section of the prestressed tube section structure, and connecting and splicing multiple segments in series into a whole; and d. after the tube section is installed in place underwater, carrying out section cutting on prestressing tendons of the tube section.

19. The construction method according to claim 18, wherein the section cutting is carried out on the prestressing tendons with a chain saw through the cutting sleeves.

20. The construction method according to claim 19, wherein after the prestressing tendons are cut, the method further comprises grouting and filling resulting cutting-off holes with cement mortar.

* * * * *